US008960872B2

(12) United States Patent
Maeshima

(10) Patent No.: US 8,960,872 B2
(45) **Date of Patent: *Feb. 24, 2015**

(54) INKJET IMAGE FORMING APPARATUS AND INK CONTAINER

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/950,198

(22) Filed: Jul. 24, 2013

(65) Prior Publication Data

US 2014/0036008 A1 Feb. 6, 2014

(30) Foreign Application Priority Data

Jul. 31, 2012 (JP) ..... 2012-169992

(51) Int. Cl.
*B41J 2/175* (2006.01)

(52) U.S. Cl.
CPC ..... *B41J 2/17546* (2013.01)
USPC ..... 347/86

(58) Field of Classification Search
USPC ..... 347/86
See application file for complete search history.

(56) References Cited

U.S. PATENT DOCUMENTS

| | | | | |
|---|---|---|---|---|
| 2002/0109761 | A1 | 8/2002 | Shimizu et al. | |
| 2003/0063147 | A1 | 4/2003 | Walker | |
| 2004/0189758 | A1 | 9/2004 | Alexia et al. | |
| 2005/0243148 | A1 | 11/2005 | Miyazawa et al. | |
| 2006/0017755 | A1* | 1/2006 | Shinada | 347/7 |
| 2007/0144378 | A1 | 6/2007 | Durham et al. | |
| 2007/0252858 | A1 | 11/2007 | Kyoshima | |
| 2010/0073442 | A1* | 3/2010 | Akiyama | 347/86 |
| 2010/0155417 | A1 | 6/2010 | Utzui et al. | |
| 2010/0272451 | A1 | 10/2010 | Durham et al. | |

FOREIGN PATENT DOCUMENTS

| | | | |
|---|---|---|---|
| DE | 19917229 | A1 | 10/2000 |
| EP | 1232871 | A1 | 8/2002 |
| EP | 1462270 | A2 | 9/2004 |

(Continued)

OTHER PUBLICATIONS

The extended European search report issued on Sep. 9, 2013, which corresponds to European Patent Application No. 13177604.9-1701 and is related to U.S. Appl. No. 13/950,198.

*Primary Examiner* — Stephen Meier
*Assistant Examiner* — Alexander D Shenderov
(74) *Attorney, Agent, or Firm* — Studebaker & Brackett PC

(57) ABSTRACT

An inkjet image forming apparatus includes an ink container and a container installed part. The ink container stores an ink, includes an RFID tag, a pouch pack and a container case. The pouch pack contains the ink and has a supply port discharging the ink. The container case houses the pouch pack and has a pack holding part holding the pouch pack and a tag fixing part. To the pack holding part, the supply port is fixed. The tag fixing part is provided adjacent to the pack holding part and has a needle insertion part. To the tag fixing part, the RFID tag is fixed at a distance from the pack holding part. The container installed part includes an RFID sensing circuit board carrying out wireless communication with the RFID tag and a needle inserted in the needle insertion part.

16 Claims, 5 Drawing Sheets

(56) References Cited

FOREIGN PATENT DOCUMENTS

| | | | |
|---|---|---|---|
| EP | 1555128 | A1 | 7/2005 |
| EP | 1619030 | A2 | 1/2006 |
| EP | 1801661 | A1 | 6/2007 |
| EP | 2202078 | A1 | 6/2010 |
| JP | 2003-167515 | A | 6/2003 |
| JP | 2010-012659 | A | 1/2010 |

* cited by examiner

INKJET IMAGE FORMING APPARATUS AND INK CONTAINER

INCORPORATION BY REFERENCE

This application is based on and claims the benefit of priority from Japanese Patent application No. 2012-169992 filed on Jul. 31, 2012, the entire contents of which are incorporated herein by reference.

BACKGROUND

The present disclosure relates to an inkjet image forming apparatus and an ink container storing an ink used in this inkjet image forming apparatus.

An inkjet image forming apparatus forms an image on a sheet surface by discharging an ink from a recording head to a sheet. The ink discharged from the recording head to the sheet is supplied from an ink container to the recording head. The ink container includes, for example, a pouch pack containing the ink and a container case housing the pouch pack. The pouch pack is formed, for instance, by flexible film material. This film material may include an electric conductive layer made by aluminum or other electric conductive material with intent to improve gas barrier property.

In addition, the ink container may be managed by a contact type sensing means or manage the ink container by RFID (Radio Frequency Identification) as a non-contact type sensing means. Concretely, between an RFID tag adhered on the container case of the ink container and an RFID sensing circuit board attached to a container installed part to which the ink container is attached/detached, wireless communication is carried out. Then, ink container information stored in the RFID tag is read out by the RFID sensing circuit board and used for managing the ink container.

SUMMARY

In accordance with an embodiment of the present disclosure, an inkjet image forming apparatus includes an ink container and a container installed part. The ink container is configured to store an ink. The ink container includes an RFID tag, a pouch pack and a container case. The pouch pack is configured to contain the ink. The pouch pack has a supply port discharging the ink. The container case is configured to house the pouch pack. The container case has a pack holding part and a tag fixing part. The pack holding part is configured to hold the pouch pack. To the pack holding part, the supply port is fixed. The tag fixing part is provided adjacent to the pack holding part and has a needle insertion part. To the tag fixing part, the RFID tag is fixed at a distance from the pack holding part. To the container installed part, the ink container is attached/detached. The container installed part includes an RFID sensing circuit board and a needle. The RFID sensing circuit board is configured to carry out wireless communication with the RFID tag. The needle is inserted in the needle insertion part.

Furthermore, in accordance with an embodiment of the present disclosure, an ink container is attached/detached to a container installed part of an inkjet image forming apparatus to store an ink. The ink container includes an RFID tag, a pouch pack and a container case. The RFID tag is configured to carry out wireless communication with an RFID sensing circuit board of the container installed part. The pouch pack is configured to contain the ink. The pouch pack includes a supply port discharging the ink. The container case is configured to house the pouch pack. The container case includes a pack holding part and a tag fixing part. The pack holding part is configured to hold the pouch pack. To the pack holding part, the supply port is fixed. The tag fixing part is provided adjacent to the pack holding part. The tag fixing part has a needle insertion part in which a needle of the container installed part is inserted. To the tag fixing part, the RFID tag is fixed at a distance from the pack holding part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
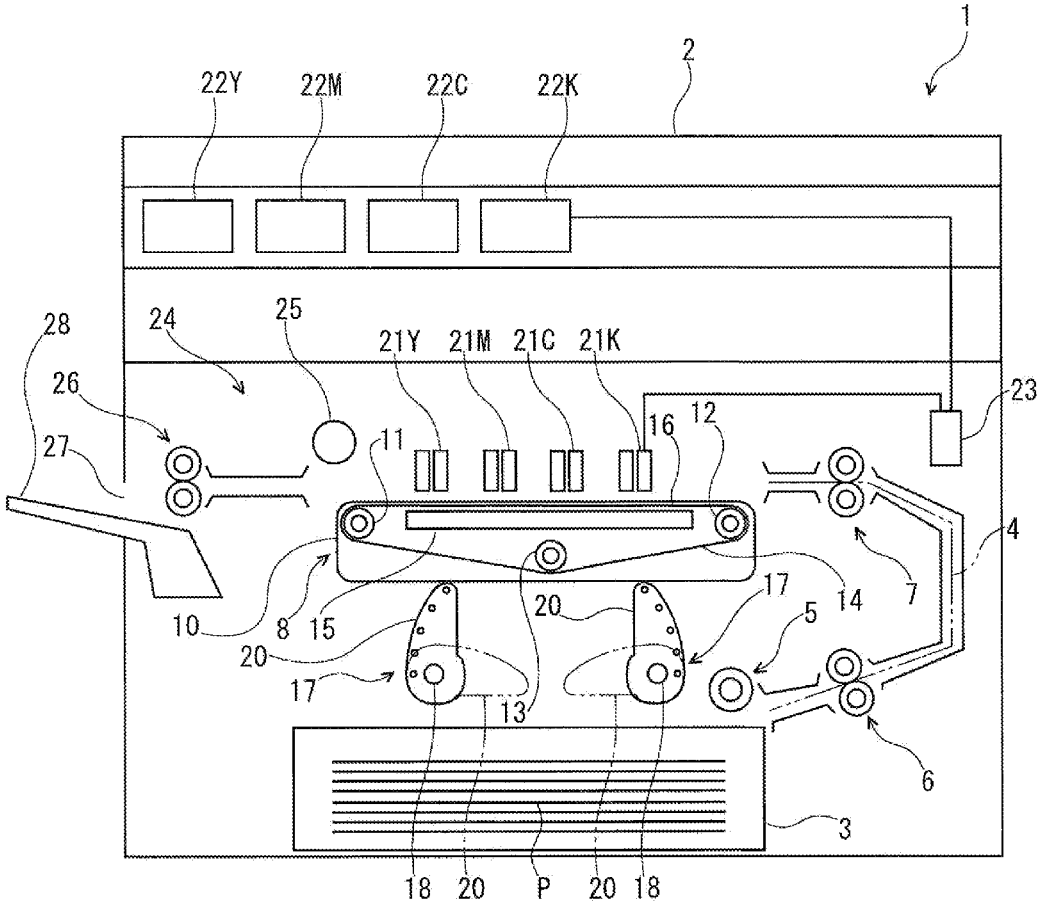
FIG. 1 is a schematic diagram schematically showing a printer according to an embodiment of the present disclosure.

First, with reference to FIG. 1, the entire structure of an inkjet color printer (an inkjet image forming apparatus) 1 will be described. Hereinafter, the inkjet color printer 1 is called as a "printer 1". Hereinafter, it will be described so that the front side of the printer 1 is positioned at this side (a reader's side) of FIG. 1.

The printer 1 includes a box-formed printer main body 2 (an apparatus main body). To a lower part of the printer main body 2, a sheet feeding cartridge 3 configured to store sheets P is installed.

In a right side part of the printer main body 2, a conveying path 4 for the sheet P is arranged. At a lower end part of the conveying path 4, a sheet feeding roller 5 is positioned near the sheet feeding cartridge 3 and, at the right side of the sheet feeding roller 5, conveying rollers 6 are positioned. At an upper end part of the conveying path 4, resist rollers 7 are positioned.

In an intermediate part of the printer main body 2, an upward/downward movable conveying unit 8 is attached. The conveying unit 8 includes a conveyance frame 10, a driving roller 11, a follower roller 12, a tension roller 13, an endless conveyance belt 14 and an air intake duct 15. The driving roller 11 is rotatably supported at a left upper corner of the conveyance frame 10. The follower roller 12 is rotatably supported at a right upper corner of the conveyance frame 10. The tension roller 13 is rotatably supported at a middle lower part of the conveyance frame 10. The conveyance belt 14 is wound around the driving roller 11, follower roller 12 and tension roller 13. The air intake duct 15 is located so as to be surrounded by the conveyance belt 14.

An upper face of the conveyance belt 14 is formed as a roughly flat conveyance face 16. The conveyance belt 14 has a lot of air intake holes (not shown) and a top face of the air intake duct 15 also has a lot of air intake holes (not shown). The air intake duct 15 is connected with a suction device (not shown), such as a suction pomp. Accordingly, by activating the suction device, an air can be sucked via the air intake holes of the conveyance belt 14 and the air intake holes of the air intake duct 15 from the conveyance face 16 side in the conveyance belt 14 to the air intake duct 15 side.

In an intermediate lower part of the printer main body 2, a pair of left and right elevating devices 17 is attached below the conveying unit 8. Each elevating device 17 includes a rotation axis 18 and a cam 20 supported by the rotation axis 18. The cam 20 is connected with a driving device (not shown), such as a driving motor. Accordingly, by activating the driving device, each cam 20 rotates around the rotation axis 18 so that a posture of the cam 20 is switched between an upright posture (refer to solid line in FIG. 1) and a laid-down posture (refer to two-dot chain line in FIG. 1). The cam 20 is switched to the upright posture to lift up the conveyance frame 10 and to move the conveying unit 8 upward or switched to the laid-down posture to release the lift of the conveyance frame 10 and to move the conveying unit 8 downward.

In the intermediate part of the printer main body 2, four recording heads 21 (21K, 21C, 21M, 21Y) are arranged in parallel above the conveying unit 8. The recording heads 21 correspond to black (K), cyan (C), magenta (M) and yellow (Y) from an upper stream side (a right side in the embodiment) in order of a conveying direction of the sheet P. Hereinafter, except for the description to be specified by the colors, the reference characters "K", "C", "M" and "Y" with regard to the recording heads 21 are omitted. The recording heads 21 are provided with respective nozzles (not shown) facing to the conveyance face 16 of the conveyance belt 14.

In the upper part of the printer main body 2, four ink containers 22 (22K, 22C, 22M, 22Y) are installed in parallel. The four ink containers 22 are provided for each ink color to store respective inks of black (K), cyan (C), magenta (M) and yellow (Y) from an upper stream side (a right side in the embodiment) in order of the conveying direction of the sheet P. Hereinafter, except for the description to be specified by the colors, the reference characters "K", "C", "M" and "Y" with regard to the ink containers 22 are omitted. In the figures, the reference characters "K", "C", "M" and "Y" with regard to the ink containers 22 are often omitted.

Each ink container 22 is connected with each recording head 21 via a sub container 23 so that the ink stored in the ink container 22 is temporarily retained in the sub container 23 and then supplied to the recording head 21. The sub container 23 is provided corresponding to each color of black (K), cyan (C), magenta (M) and yellow (Y) similar to the recording heads 21 and ink containers 22. In FIG. 1, the sub container 23 corresponding to black (K) is illustrated and the other sub containers 23 corresponding to the other colors are omitted.

In a left side part of the printer main body 2, an ejecting mechanism 24 is arranged. The ejecting mechanism 24 includes a drying device 25, ejecting rollers 26 and a sheet ejecting tray 28. The drying device 25 is located at the left upper side of the conveying unit 8. The ejecting rollers 26 are located at the left side of the drying device 25. The sheet ejecting tray 28 is located below the ejecting rollers 26 and protruded outside of the printer main body 2 via an ejecting port 27.

Next, the operation of forming an image by the printer 1 having such a configuration will be described.

In the printer 1, when image data is received from an external computer or the like, the sheet P stored in the sheet feeding cartridge 3 is fed to the conveying path 4 by the sheet feeding roller 5. The sheet P fed to the conveying path 4 is conveyed to a lower stream side of the conveying path 4 by the conveying rollers 6 and fed from the conveying path 4 to the conveyance face 16 of the conveyance belt 14 by the resist rollers 7.

The sheet P fed to the conveyance face 16 of the conveyance belt 14 is absorbed to the conveyance face 16 of the conveyance belt 14 by suction force of the suction device (not shown) connected with the air intake duct 15. To the sheet P absorbed to the conveyance face 16, each recording head 21 discharges the ink on the basis of the information of the image data received from the external computer or the like. Thereby, a color ink image is formed on the sheet P. The sheet P having the color ink image is advanced so that the ink on the surface is dried by the drying device 25, and then, ejected on the sheet ejecting tray 28 by the ejecting rollers 26.

Next, the upper part of the printer main body 2 will be described in detail. Arrows Fr shown in FIG. 2 and following figures indicate the front side of the printer 1.

Figure 2:
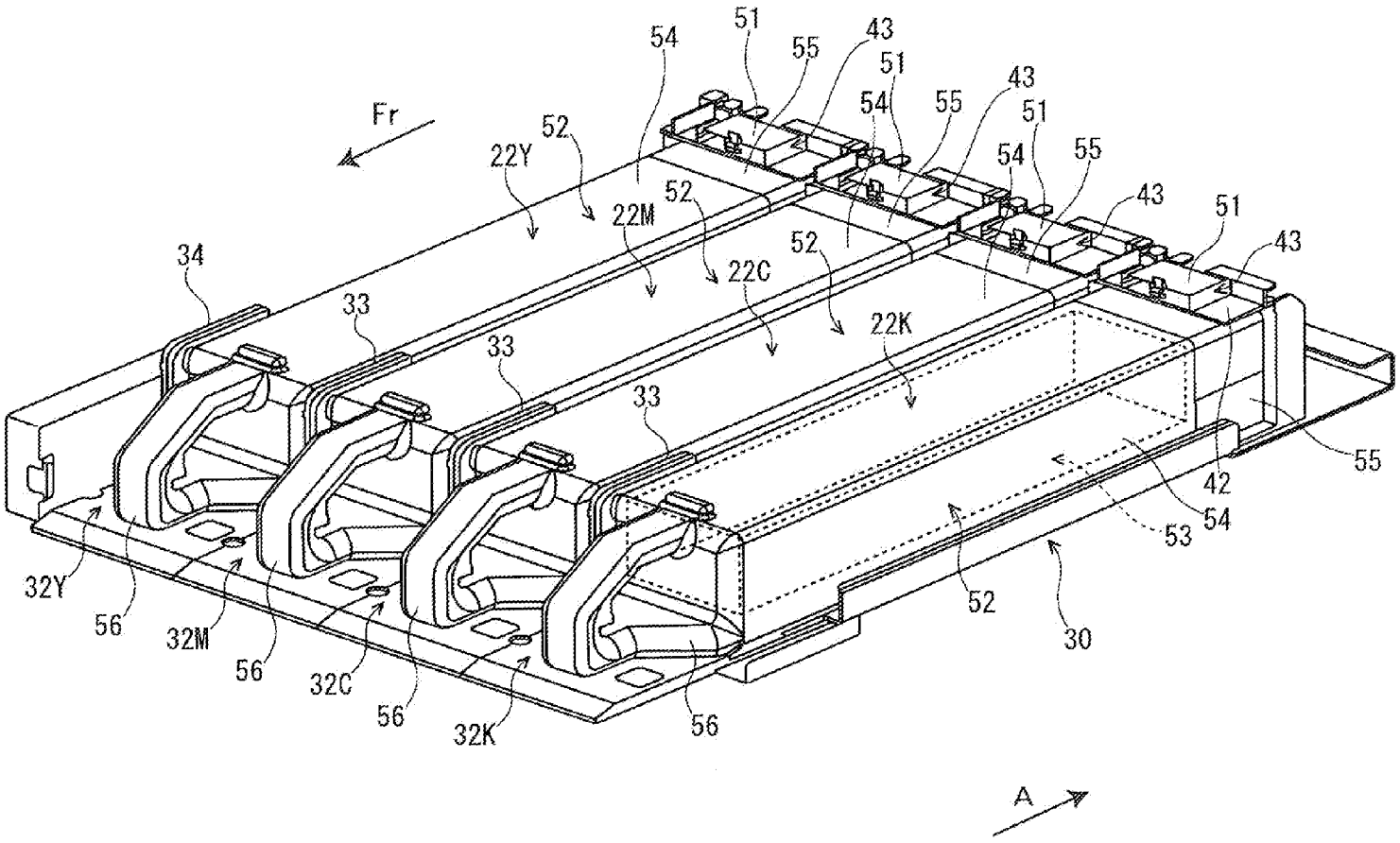
FIG. 2 is a perspective view showing the printer in a situation, in which ink containers are attached to respective container installed parts, according to the embodiment of the present disclosure.

As shown in FIG. 2, in the upper part of the printer main body 2, an installation frame 30 is provided. In the installation frame 30, four container installed parts 32 (32K, 32C, 32M, 32Y) extending in forward and backward directions or a depth direction are arranged for every ink colors. To the container installed parts 32, the ink containers 22 of black (K), cyan (C), magenta (M) and yellow (Y) are arranged from the right so as to be attached/detached along the forward and backward directions. In the embodiment, the front side of the printer 1 is a front side (a user's side) in an installing direction of the ink container 22 to the container installed part 32 and the rear side of the printer 1 is a rear side in the installing direction of the ink container 22 to the container installed part 32. Arrows A shown in FIG. 2 and following figures indicate the installing direction of the ink container 22 to the container installed part 32. Hereinafter, except for the description to be specified by the colors, the reference characters "K", "C", "M" and "Y" with regard to the container installed parts 32 are omitted. In the figures, the reference characters "K", "C", "M" and "Y" with regard to the container installed parts 32 are often omitted.

As shown in FIG. 2, in a front part of the installation frame 30, three partition boards 33 extending in the forward and backward directions are stood at intervals in left and right directions or a horizontal direction so that the container installed parts 32 are partitioned by the partition boards 33. At the left side of the left end container installed part 32 (the container installed part 32Y), a guide board 34 in the same form as the partition board 33 is stood.

Figure 3:
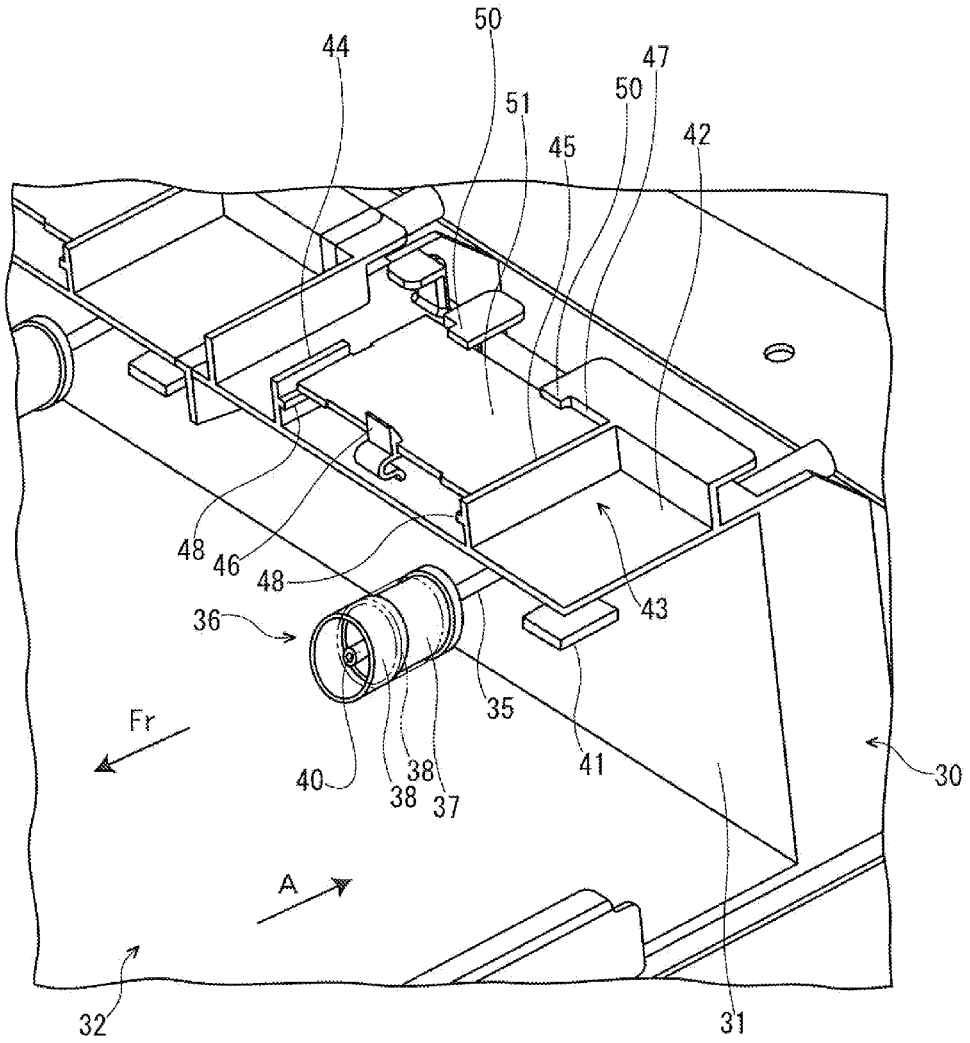
FIG. 3 is a perspective view showing a rear part and the periphery of the container installed part in a situation, in which the ink container is detached, in the printer according to the embodiment of the present disclosure.

As shown in FIG. 3, on a rear face 31 of the installation frame 30, a needle 35 is protruded forward at a correspondent position to the container installed part 32. The needle 35 is a tube-like member internally having an ink supply path (not shown) and is connected to the sub container 23 (refer to FIG. 1). To a top end side of the needle 35, an installation pipe 36 is attached. The installation pipe 36 includes a fixed pipe part 37 fixed on a circumference of the needle 35 and a movable pipe part 38 installed on a circumference of the fixed pipe part 37. The movable pipe part 38 is configured to advance and retreat between a position (refer to two-dot chain line in FIG.

3) exposing a top end part 40 of the needle 35 and another position (refer to solid line in FIG. 3) covering the top end part 40 of the needle 35 in the forward and backward directions.

On the rear face 31 of the installation frame 30, a protrusion 41 is protruded forward at a correspondent position to the container installed part 32. The protrusion 41 is provided adjacent to the needle 35 at the right side of the needle 35. The protrusion 41 is positioned according to a specification of the printer main body 2. That is, with regard to another printer main body having a different specification from the printer main body 2 of the embodiment, another protrusion is formed at another position, e.g. at the left side of the needle, differed from the printer main body 2 of the embodiment.

In a rear end part of the installation frame 30, an upper frame 42 extending in the left and right directions is formed so as to cover upper sides of the needle 35 and protrusion 41 of each container installed part 32. In an upper face of the upper frame 42, a circuit board holding part 43 is provided at a correspondent position to the container installed part 32. The circuit board holding part 43 includes left and right side boards 44 and 45 extending in the forward and backward directions, a hook 46 provided between a front end part of the left side board 44 and a front end part of the right side board 45, and a rear board 47 provided at a rear end side of the left side board 44 and right side board 45. In an internal face (a right face) of the left side board 44 and an internal face (a left face) of the right side board 45, extruded strips 48 extending in the forward and backward directions are formed. In an upper end of the rear board 47, a pair of left and right ribs 50 are protruded forward.

In the circuit board holding part 43, an RFID (Radio Frequency Identification) sensing circuit board 51 is held in a slight separated state from the upper frame 42. Both left and right end parts of a lower face of the RFID sensing circuit board 51 are put on the extruded strips 48 respectively formed in the left side board 44 and right side board 45 of the circuit board holding part 43. The RFID sensing circuit board 51 is restrained from moving forward by the hook 46, restrained from moving backward by the rear board 47 and restrained from moving upward by the hook 46 and ribs 50 of the rear board 47.

Next, the ink container 22 will be described in detail.

As shown in FIG. 2, each ink container 22 includes a container case 52 and a pouch pack 53 housed in the container case 52. Although the pouch pack 53 is provided for each ink container 22, FIG. 2 illustrates the pouch pack 53 for the right end ink container 22 (the ink container 22K) by a broken line and omits other pouch packs 53 for other ink containers 22.

First, the container case 52 will be described. The container case 52 is formed in an extended shape in the forward and backward directions. The container case 52 includes a pack holding part 54, a tag fixing part 55 connected to a rear end part of the pack holding part 54 and a lever 56 connected to a front end part of the pack holding part 54. A description of the lever 56 is omitted.

Figure 4A:
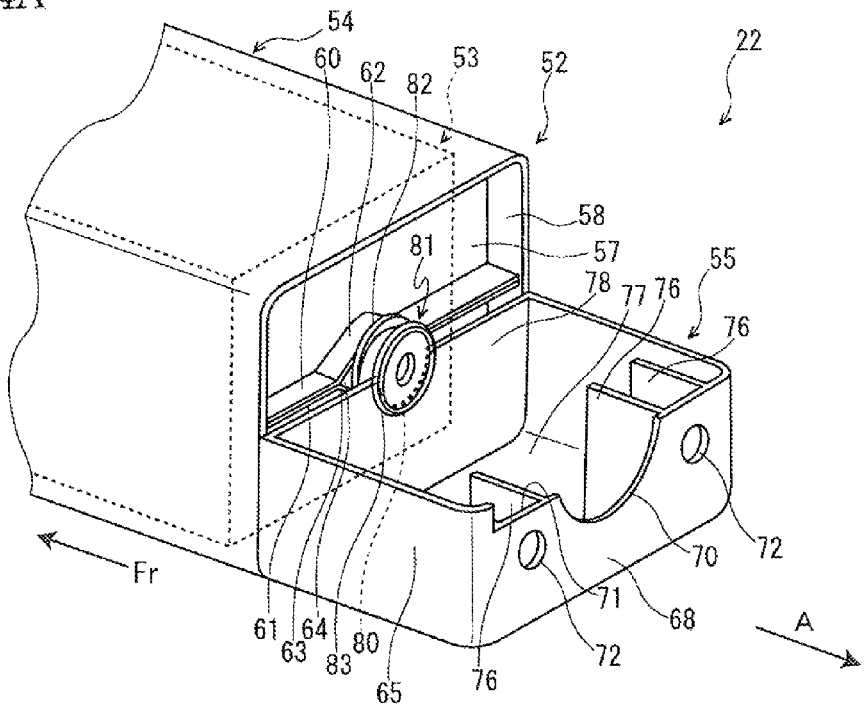
FIG. 4A is a perspective view showing a rear part and the periphery of the ink container without illustrations of a first upper side part and a second upper side part of a tag fixing part in the printer according to the embodiment of the present disclosure.

The pack holding part 54 is formed in a roughly rectangular parallelepiped box-like shape. As shown in FIG. 4A, on a circumference of a rear wall part 57 (a wall part at a rear side in the installing direction) of the pack holding part 54, a roughly rectangular frame-like holding frame 58 is protruded backward. In a center in upward and downward directions of the holding frame 58, between a right part and a left part of the holding frame 58, a pair of upper and lower holding boards 60 and 61 are bridged roughly horizontally. The holding boards 60 and 61 are overlapped in the upward and downward directions. In a center in the left and right directions of the upper holding part 60, an upper curved part 62 curved upward in an arc-like shape is formed and, in a center in the left and right directions of the lower holding part 61, a lower curved part 63 curved downward in an arc-like shape is formed. Between the upper curved part 62 and lower curved part 63, a spout insertion part 64 is formed.

Figure 4B:
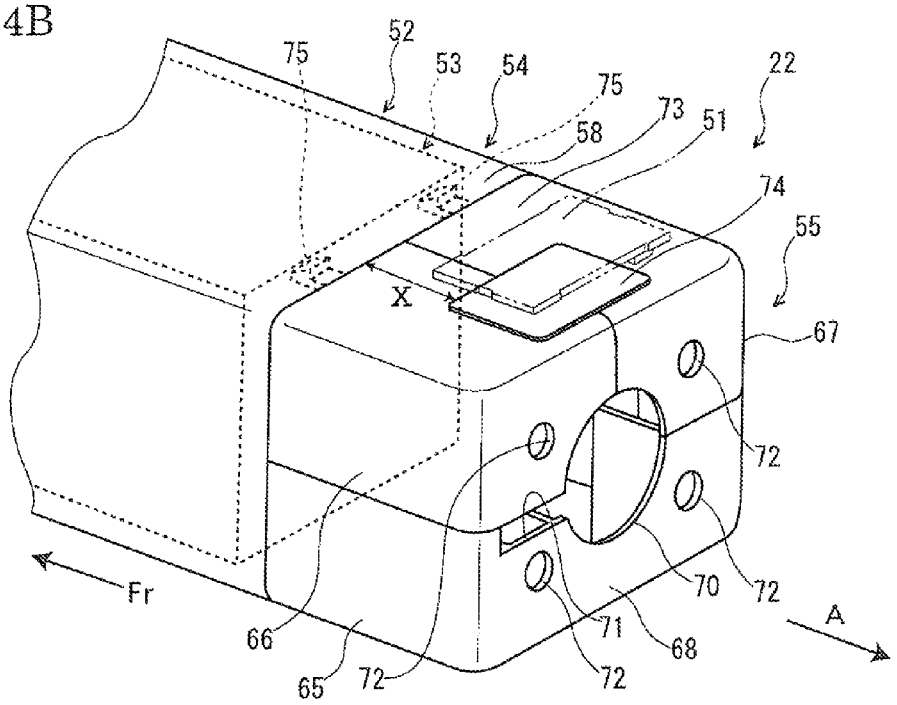
FIG. 4B is another perspective view showing the rear part and the periphery of the ink container in the printer according to the embodiment of the present disclosure.
Figure 5A:
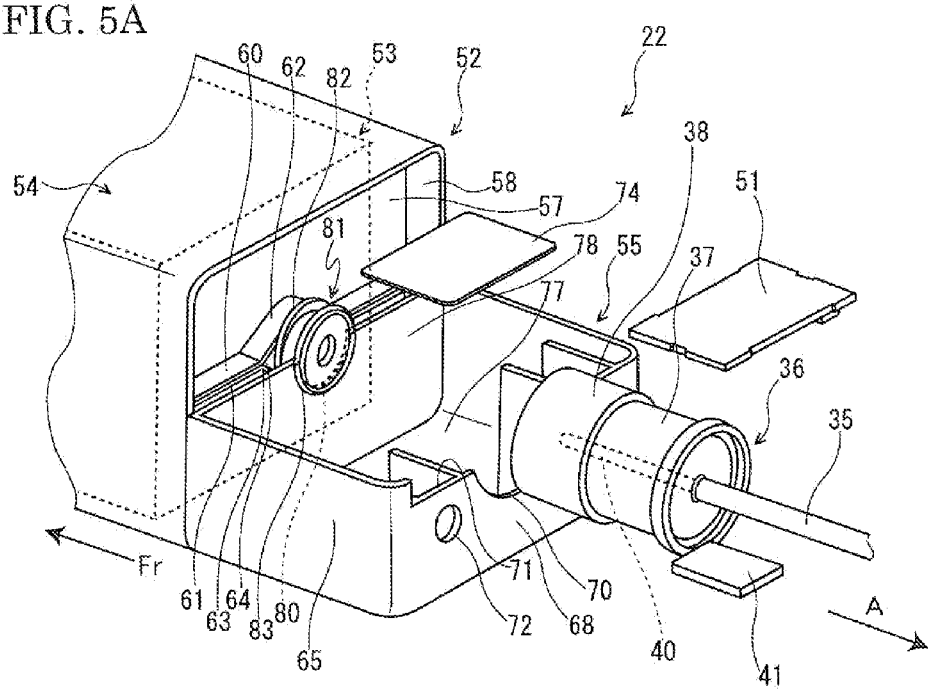
FIG. 5A is a perspective view showing a situation in the middle of installing the ink container to the container installed part in the printer according to the embodiment of the present disclosure.
Figure 5B:
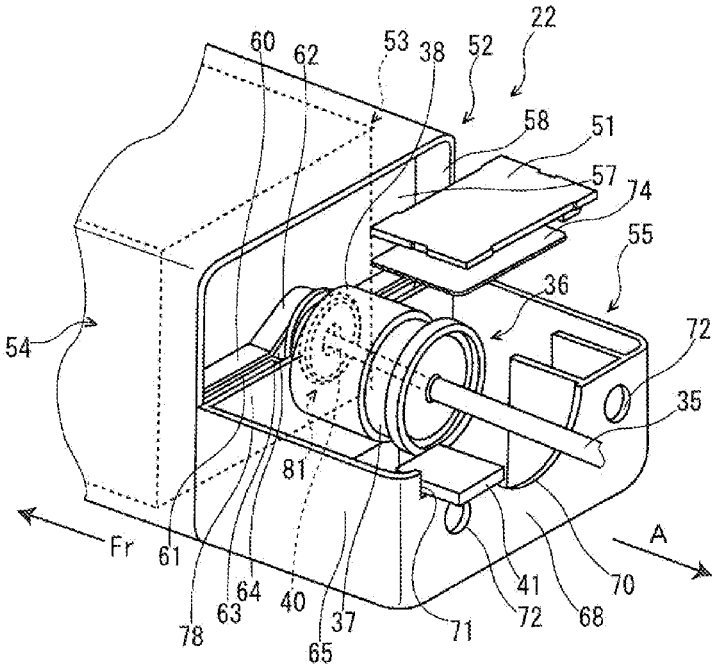
FIG. 5B is another perspective view showing another situation in which the ink container is completely attached to the container installed part in the printer according to the embodiment of the present disclosure.

The tag fixing part 55 is provided adjacent to a rear side (the rear side in the installing direction) of the pack holding part 54. As shown in FIG. 4B, the tag fixing part 55 includes a lower side part 65, a first upper side part 66 covering a right upper side (a left upper side on the figure) of the lower side part 65 and a second upper side part 67 covering a left upper side (a right upper side on the figure) of the lower side part 65. The tag fixing part 55 is formed in a roughly rectangular parallelepiped box-like shape as a whole. In FIGS. 4A, 5A and 5B, in order to clarify the rear wall part 57 of the pack holding part 54 and the periphery, the first upper side part 66 and second upper side part 67 of the tag fixing part 55 are omitted. Hereinafter, it conveniently will be described so that the lower side part 65 and the upper side parts 66 and 67 are not distinguished, but united into one tag fixing part 55.

As shown in FIG. 4B, in a center of a rear side wall part (a first wall part) 68 of the tag fixing part 55, a circular hole-like needle insertion part 70 is formed. In the rear side wall part 68 of the tag fixing part 55, a laterally long rectangle-like notch part 71 is formed adjacent to a right side (a left side on the figure) of the needle insertion part 70. The notch part 71 is continued from the needle insertion part 70. The notch part 71 is positioned differently in accordance with the ink container 22 corresponding to a specification of the printer main body 2. That is, with regard to another ink container to be installed in another printer main body having a different specification from the printer main body 2 of the embodiment, another notch part is formed at another position, e.g. at the left side of the needle insertion part, differed from the ink container 22 of the embodiment. In the rear side wall part 68 of the tag fixing part 55, four circular positioning holes 72 are formed at a right upper side, a left upper side, a right lower side and a left lower side of the needle insertion part 70, respectively.

To a rear part of an upper side wall part (a second wall part) 73 of the tag fixing part 55, an RFID tag 74 is adherently fixed at a distance X in the forward and backward directions from the pack holding part 54. The ink container 22 and container installed part 32 are configured that, in a state that the ink container 22 is attached to the container installed part 32, the RFID sensing circuit board 51 of the container installed part 32 and RFID tag 74 are faced to each other so as to carry out wireless communication between the RFID sensing circuit board 51 and RFID tag 74.

The RFID tag 74 includes a non-volatile memory and the memory stores information regarding the ink container 22, for example, the model number, the date of manufacture, the serial number, the usage history, the ink color and other information. In the embodiment, such information may be read out by the RFID sensing circuit board 51 and outputted to a controller (not shown), and then, the controller carries out various decisions on the basis of the information. The above-mentioned various decisions include, for example, a decision whether or not the ink container 22 is a genuine product and another decision whether or not the ink container 22 is an unused product. Thus, in the embodiment, the RFID is used as a sensing device for managing the ink container 22.

On a front end part of the upper side wall part 73 of the tag fixing part 55, a pair of left and right engaging pieces 75 are protruded forward. Each engaging piece 75 engages with an upper part of the holding frame 58 of the pack holding part 54.

As shown in FIG. 4A, in a rear part of an internal space of the tag fixing part 55, four reinforcement boards 76 are provided at distances in the left and right directions so that sets of the two reinforcement boards are respectively arranged at both left and right sides of the needle insertion part 70. Each reinforcement board 76 is formed integrally with the rear side wall part 68 and a lower side wall part 77 of the tag fixing part 55. In a center of a front side wall part 78 of the tag fixing part 55, a circular spout installation hole 80 (the figure illustrates a lower side semicircle part of this hole) is formed.

Next, the pouch pack 53 will be described. The pouch pack 53 is formed like a bag. In the pouch pack 53, the ink is contained in a vacuum. The pouch pack 53 is made of pliability (flexible) film material. This film material is formed by laminating resin and aluminum. As an example, from a top surface, in order, polyester (PET), aluminum (AL), nylon (PA) and low level density polyethylene (LLDPE) are laminated. Because the top surface is made of polyester, the external appearance and the strength of the pouch pack 53 can be increased. Because an aluminum layer is made, gas barrier property of the pouch pack 53 can be increased to heighten storage stability of the ink. That is, in the embodiment, aluminum is used as a barrier material. A nylon layer enables impact resistance and mechanical strength of the pouch pack 53 to be increased. Because a back surface is made of low level density polyethylene, it is possible to heighten welding strength when the film material is shaped like a bag by welding, and then, to increase sealing quality.

The pouch pack 53 is held in the pack holding part 54 of the container case 52. As shown in FIG. 4A, in a rear end part (an end part at the rear side in the installing direction) of the pouch pack 53, a cylinder-like spout (a supply port) 81 is welded so that the ink contained in the pouch pack 53 can be ejected via the spout 81.

As shown in FIG. 4A, the spout 81 is fixed to the rear wall part 57 of the pack holding part 54. The spout 81 is inserted in the spout insertion part 64 of the pack holding part 54 and inserted in the spout installation hole 80 of the tag fixing part 55 and is opened to an inside of the tag fixing part 55. On a circumference of the spout 81, a front side collar part 82 and a rear side collar part 83 are formed. The front side collar part 82 is positioned at a rear side from the spout insertion part 64 of the pack holding part 54 and at a front side from the spout installation hole 80 of the tag fixing part 55. The rear side collar part 83 is positioned at a rear side from the spout installation hole 80 of the tag fixing part 55.

In the above-mentioned configuration, in a state before the ink container is installed to the container installed part 32, as shown in FIG. 3, the top end part 40 of the needle 35 is covered by the movable pipe part 38 of the installation pipe 36. Subsequently to this state, as the ink container 22 is installed from the front side to the container installed part 32, as shown in FIG. 5A, the spout 81 of the ink container 22 approaches to the needle 35 of the container installed part 32. As the installation of the ink container 22 is moreover advanced, the needle 35 and installation pipe 36 of the container installed part 32 are inserted in the needle insertion part 70 formed in the rear side wall part 68 of the tag fixing part 55 of the ink container 22.

When the installation of the ink container 22 is further advanced and the ink container 22 is completely attached to the container installed part 32, as shown in FIG. 5B, the movable pipe part 38 of the installation pipe 36 is pressed backward by the front side wall part 78 of the tag fixing part 55 of the ink container 22. By this pressure, the movable pipe part 38 retreats from the fixed pipe part 37, the top end part 40 of the needle 35 is exposed and the exposed top end part 40 of the needle 35 is inserted in the spout 81 of the ink container 22 from the container installed part 32. Thereby, it is possible to supply the ink in the pouch pack 53 to the sub container 23 (refer to FIG. 1) via the needle 35. On the other hand, when the ink container 22 is detached from the container installed part 32, the movable pipe part 38 of the installation pipe 36 advances from the fixed pipe part 37 to a position covering the top end part 40 of the needle 35 by a biasing strength of a biasing member (not shown).

When the attachment of the ink container 22 to the container installed part 32 is completed as mentioned above, the RFID tag 74 of the ink container 22 is moved to a lower side of the RFID sensing circuit board 51 of the container installed part 32, and then, the RFID tag 74 and RFID sensing circuit board 51 are faced to each other. Thereby, it is possible to read out the information stored in the memory of the RFID tag 74 by the RFID sensing circuit board 51.

Incidentally, when the RFID is used for managing the ink container 22 including the pouch pack 53 with the film material having the electric conductive layer, if the RFID tag 74 adhered on the container case 52 and pouch pack 53 were too close, the electric conductive layer of the film material of the pouch pack 53 may hinder the wireless communication between the RFID tag 74 and RFID sensing circuit board 51. In such a case, the RFID sensing circuit board 51 may not read out the information stored in the RFID tag 74.

On the other hand, in order to sufficiently separate the RFID tag 74 and pouch pack 53, if, simply, a certain space were put between an adhesion part of the RFID tag 74 and a housing part of the pouch pack 53 in the container case 52, the pouch pack 53 may become easily vibrated inside the container case 52 by impact or the like during transportation. In such a case, it is possible that a load of weight or the like of the ink concentrates on a fixing part of the pouch pack 53 and container case 52 and that damage of the pouch pack 53 is occurred.

However, in accordance with the embodiment, as shown in FIG. 4B, the RFID tag 74 is fixed at the distance X in the forward and backward directions from the pack holding part 54 to the tag fixing part 55. Therefore, even if the film material of the pouch pack 53 includes the electric conductive layer (the aluminum layer in the embodiment), it is possible to surely exert the function of the RFID.

In addition, because the pack holding part 54 of the ink container 22 holds the pouch pack 53, it is possible to restrain vibration of the pouch pack 53 in the container case 52 in the forward and backward directions caused by impact or the like during transportation. According to this, load to the pouch pack 53 may be reduced, and then, it is possible to prevent damage of a fixing part (e.g. a periphery part of the spout 81) of the pouch pack 53 to the container case 52. By restraining the vibration of the pouch pack 53 as mentioned above, it is also possible to decrease the load to not only the pouch pack 53 but also the container case 52. Thus, in accordance with the embodiment, by providing the tag fixing part 55 to arrange the distance between the RFID tag 74 and pouch pack 53, the vibration of the pouch pack 53 in the container case 52 can be restrained.

Moreover, in the printer 1 of the embodiment, in a case where the ink container 22 being consistent in the specification of the printer main body 2 is installed to the container installed part 32, as shown in FIG. 5B, the position of the notch part 71 of the ink container 22 corresponds to the position of the protrusion 41 of the container installed part 32, and then, the protrusion 41 engages with the notch part 71. By contrast, in another case where another ink container not being consistent in the specification of the printer main body 2 is installed to the container installed part 32, the position of another notch part does not correspond to the position of the protrusion 41, and then, the protrusion 41 interferes with the rear side wall part 68 of the tag fixing part 55. By such a configuration, it is possible to prompt a user to install the ink container 22 being consistent in the specification of the printer main body 2 to the container installed part 32. Therefore, it is possible to carry out the image forming operation by suitable ink on the basis of the print quality, print speed, a purpose and other elements of the printer main body 2.

Further, in accordance with the embodiment, because the spout 81 is opened to the box-formed tag fixing part 55, even if the ink is dropped from the spout 81, this ink is held in the tag fixing part 55. According to this, it is possible to prevent the ink leakage without providing a shutter in the ink container 22. Therefore, it is possible to simplify the configuration of the ink container 22 and to decrease manufacturing cost of the ink container 22.

Furthermore, in accordance with the embodiment, because the ink container 22 has a space-saved and simple shape, it is possible to minimize the ink container 22 itself and to sufficiently secure a capacity of the pouch pack 53.

Although as the embodiment, the tag fixing part 55 is formed in a box-like shape, as another embodiment, the tag fixing part 55 may be formed in a plan board-like shape.

In the above embodiment, when the ink container 22 being consistent in the specification of the printer main body 2 is installed to the container installed part 32, the protrusion 41 of the container installed part 32 engages with the notch part 71 of the ink container 22. By contrast, in another embodiment, when the ink container 22 is installed to the container installed part 32 being consistent in the ink color, the protrusion 41 of the container installed part 32 may be configured to engage with the notch part 71 of the ink container 22. To apply such a configuration, by using the protrusion 41 and notch part 71, it is possible to prevent the ink container 22 from being installed in mistake to the container installed part 32 not being consistent in the ink color. In this case, for example, the protrusion 41 adjacent to the needle 35 is positioned differently for each container installed part 32 and the notch part 71 adjacent to the needle insertion part 70 is positioned differently for each container case 22. In a further embodiment, by using the protrusion 41 and notch part 71, a user may be prompted to install the ink container 22 in a genuine destination to the container installed part 32.

In the above embodiment, the spout (a supply port) 81 is formed in the rear end part (the end part at the rear side in the installing direction) of the pouch pack 53. By contrast, in another embodiment, for example, the spout 81 may be formed in a front end part (another end part at a front side in the installing direction), upper and lower parts or left and right parts of the pouch pack 53.

In the above embodiment, the spout (a supply port) 81 is fixed to the rear wall part 57 (the wall part at the rear side in the installing direction) of the pack holding part 54. By contrast, in another embodiment, the spout (a supply port) 81 may be fixed to a front wall part (another wall part at the front side in the installing direction), upper and lower wall parts or left and right wall parts of the pack holding part 54.

In the above embodiment, the tag fixing part 55 is provided adjacent to the rear side (the rear side in the installing direction) of the pack holding part 54. By contrast, in another embodiment, the tag fixing part 55 may be provided adjacent to a front side (the front side in the installing direction), upper and lower parts or left and right parts of the pack holding part 54.

In the above embodiment, the needle insertion part 70 and notch part 71 are formed in the rear side wall part (a wall part at the rear side in the installing direction) 68 of the tag fixing part 55. By contrast, in another embodiment, the needle insertion part 70 and notch part 71 may be formed in a front side wall part (another wall part at the front side in the installing direction), upper and lower wall parts or left and right wall parts of the tag fixing part 55. In the above embodiment, the RFID tag 74 is fixed to the upper side wall part (an adjacent wall part to the wall part at the rear side in the installing direction) 73 of the tag fixing part 55. By contrast, in another embodiment, the RFID tag 74 may be fixed to a lower side wall part, front and rear wall parts or left and right wall parts of the tag fixing part 55.

Although in the embodiment, configurations of the disclosure are applied to the printer 1, in another embodiment, the ideas of the disclosure may be applied to another inkjet image forming apparatus, such as a copying machine, a facsimile or a multifunction machine.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. An inkjet image forming apparatus comprising:

an ink container configured to store an ink, wherein the ink container includes:

an RFID tag;

a pouch pack configured to contain the ink and to have a supply port discharging the ink; and a container case configured to house the pouch pack, wherein the container case has:

a pack holding part configured to hold the pouch pack, to which the supply port is fixed; and a tag fixing part provided adjacent to the pack holding part and having a needle insertion part, to which the RFID tag is fixed at a distance from the pack holding part; and a container installed part to which the ink container is attached/detached, wherein the container installed part includes:

an RFID sensing circuit board configured to carry out wireless communication with the RFID tag; and a needle inserted in the needle insertion part, wherein the container installed part is provided in an apparatus main body of the inkjet image forming apparatus and further includes a protrusion adjacent to the needle, wherein the protrusion is positioned according to a specification of the apparatus main body, the tag fixing part further has a notch part adjacent to the needle insertion part, wherein the notch part is positioned according to the ink container corresponding to the specification of the apparatus main body, when the ink container corresponding to the specification of the apparatus main body is installed to the container installed part, the protrusion engages with the notch part, and the needle insertion part and the notch part are formed in the same wall part of the tag fixing part.

2. The inkjet image forming apparatus according to claim 1, wherein the tag fixing part is formed in a box-like shape, and the supply port is opened to an inside of the tag fixing part.

3. The inkjet image forming apparatus according to claim 2, wherein reinforcement boards are provided at both sides of the needle insertion part in an internal space of the tag fixing part.

4. The inkjet image forming apparatus according to claim 2, wherein the tag fixing part further has:

a lower side part; and a first upper side part and a second upper side part configured to cover an upper side of the lower side part.

5. The inkjet image forming apparatus according to claim 1, wherein the pouch pack is made of a film material formed by laminating resin and aluminum.

6. The inkjet image forming apparatus according to claim 1, wherein the needle insertion part is formed in a first wall part of the tag fixing part, and the RFID tag is fixed to a second wall part adjacent to the first wall part of the tag fixing part.

7. The inkjet image forming apparatus according to claim 6, wherein a pair of engaging pieces are protruded on the second wall part, wherein the engaging pieces is configured to engage with the pack holding part.

8. An inkjet image forming apparatus comprising:

an ink container configured to store an ink, wherein the ink container includes:

an RFID tag;

a pouch pack configured to contain the ink and to have a supply port discharging the ink; and a container case configured to house the pouch pack, wherein the container case has:

a pack holding part configured to hold the pouch pack, to which the supply port is fixed; and a tag fixing part provided adjacent to the pack holding part and having a needle insertion part, to which the RFID tag is fixed at a distance from the pack holding part; and a container installed part to which the ink container is attached/detached, wherein the container installed part includes:

an RFID sensing circuit board configured to carry out wireless communication with the RFID tag; and a needle inserted in the needle insertion part, wherein a plurality of the ink containers and a plurality of the container installed parts respectively corresponding to ink colors are provided, wherein the container installed part further includes a protrusion adjacent to the needle, wherein the protrusion is provided at a different position from other container installed parts, the tag fixing part of the ink container further has a notch part adjacent to the needle insertion part, wherein the notch part is provided at a different position from other ink containers, when the ink container is installed to the container installed part being consistent in the ink color, the protrusion is configured to engage with the notch part and the needle insertion part and the notch part are formed in the same wall part of the tag fixing part.

9. An ink container being attached/detached to a container installed part of an inkjet image forming apparatus to store an ink, comprising:

an RFID tag configured to carry out wireless communication with an RFID sensing circuit board of the container installed part;

a pouch pack configured to contain the ink and to include a supply port discharging the ink; and a container case configured to house the pouch pack, wherein the container case includes:

a pack holding part configured to hold the pouch pack, to which the supply port is fixed; and a tag fixing part, to which the RFID tag is fixed at a distance from the pack holding part, provided adjacent to the pack holding part and having a needle insertion part in which a needle of the container installed part is inserted, wherein the container installed part is provided in an apparatus main body of the inkjet image forming apparatus and further includes a protrusion adjacent to the needle, wherein the protrusion is positioned according to a specification of the apparatus main body, the tag fixing part further has a notch part adjacent to the needle insertion part, wherein the notch part is positioned according to the ink container corresponding to the specification of the apparatus main body, when the ink container corresponding to the specification of the apparatus main body is installed to the container installed part, the protrusion engages with the notch part, and the needle insertion part and the notch part are formed in the same wall part of the tag fixing part.

10. The ink container according to claim 9, wherein the tag fixing part is formed in a box-like shape, and the supply port is opened to an inside of the tag fixing part.

11. The ink container according to claim 10, wherein reinforcement boards are provided at both sides of the needle insertion part in an internal space of the tag fixing part.

12. The ink container according to claim 10, wherein the tag fixing part includes:

a lower side part; and a first upper side part and a second upper side part configured to cover an upper side of the lower side part.

13. The ink container according to claim 9, wherein a plurality of the ink containers and a plurality of the container installed parts respectively corresponding to a plurality of ink colors are provided, the container installed part further includes a protrusion adjacent to the needle, wherein the protrusion is provided at a different position from other container installed parts, the tag fixing part of the ink container further has a notch part adjacent to the needle insertion part, wherein the notch part is provided at a different position from other ink containers, and when the ink container is installed to the container installed part being consistent in the ink color, the protrusion is configured to engage with the notch part.

14. The ink container according to claim 9, wherein the pouch pack is made of a film material formed by laminating resin and aluminum.

15. The ink container according to claim 9, wherein the needle insertion part is formed in a first wall part of the tag fixing part, and the RFID tag is fixed to a second wall part adjacent to the first wall part of the tag fixing part.

16. The ink container according to claim 15, wherein a pair of engaging pieces are protruded on the second wall part, wherein the engaging pieces is configured to engage with the pack holding part.

* * * * *